US010784022B1

(12) United States Patent
Lee

(10) Patent No.: US 10,784,022 B1
(45) Date of Patent: Sep. 22, 2020

(54) CABLE STRUCTURE

(71) Applicant: Cheng Uei Precision Industry Co., Ltd., New Taipei (TW)

(72) Inventor: James Cheng Lee, La Habra, CA (US)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 16/452,676

(22) Filed: Jun. 26, 2019

(30) Foreign Application Priority Data

Apr. 15, 2019 (CN) ..... 2019 2 0511242 U

(51) Int. Cl.

| | |
|---|---|
| ***H01B 11/04*** | (2006.01) |
| ***H01B 11/18*** | (2006.01) |
| ***H01B 3/44*** | (2006.01) |
| ***H01B 7/02*** | (2006.01) |

(52) U.S. Cl.
CPC ..... *H01B 11/1895* (2013.01); *H01B 3/441* (2013.01); *H01B 7/02* (2013.01); *H01B 11/1891* (2013.01)

(58) Field of Classification Search
CPC ..... H01B 11/04; H01B 7/04; H01B 11/20
See application file for complete search history.

(56) References Cited

U.S. PATENT DOCUMENTS

| | | | | |
|---|---|---|---|---|
| 3,324,233 A | | 6/1967 | Bryant | |
| 5,418,878 A | * | 5/1995 | Sass | G02B 6/4416 385/101 |
| 6,631,095 B1 | * | 10/2003 | Bryant | H01B 7/045 367/20 |
| 9,508,467 B2 | * | 11/2016 | Pon | H01B 9/003 |
| 10,047,519 B2 | * | 8/2018 | Li | B32B 27/304 |
| 10,147,523 B2 | * | 12/2018 | Rengert | H01B 3/445 |
| 2016/0020002 A1 | * | 1/2016 | Feng | H01B 11/20 174/103 |
| 2016/0225488 A1 | | 8/2016 | Pon et al. | |

FOREIGN PATENT DOCUMENTS

| | | |
|---|---|---|
| CN | 201170976 Y | 12/2008 |
| CN | 204010815 U | 12/2014 |
| CN | 207895879 U | 9/2018 |

OTHER PUBLICATIONS

European Patent Office, Search Report with Written opinion, Patent Application No. EP19182536, dated Jan. 30, 2020.

* cited by examiner

*Primary Examiner* — Chau N Nguyen
(74) *Attorney, Agent, or Firm* — Lin & Associates Intellectual Property, Inc.

(57) ABSTRACT

A cable structure includes at least one stuffing element, a first transmission module surrounding outside the at least one stuffing element, a first shielding layer surrounding outside the first transmission module, a second transmission module surrounding outside the first shielding layer, a second shielding layer surrounding outside the second transmission module, a woven layer surrounding outside the second shielding layer, an insulating skin surrounding outside the woven layer, a plurality of first core wire assemblies disposed in the first transmission module and the second transmission module, respectively, and at least one second core wire assembly disposed in the first transmission module or the second transmission module. A diameter of each first core wire assembly is different from a diameter of each second core wire assembly.

7 Claims, 2 Drawing Sheets

CABLE STRUCTURE

BACKGROUND OF THE INVENTION

1. Field of the Invention

The present invention generally relates to a cable structure, and more particularly to a cable structure for making conductive wires of the cable structure maintain stable electrical signal transmissions in designs of the conductive wires of the cable structure with different lengths.

2. The Related Art

With reference to FIG. 2, a sectional view of a cable structure 100' in prior art is shown. The cable structure 100' includes at least one stuffing element 1', a first transmission module 2', a first shielding layer 3', a second transmission module 4', a second shielding layer 5', a woven layer 6' and an insulating skin 7' arranged in sequence, and arranged from an inside of the cable structure 100' to an outside of the cable structure 100'. The at least one stuffing element 1' is disposed in a center of the cable structure 100'. The first transmission module 2' surrounds outside the at least one stuffing element 1'. The first shielding layer 3' surrounds outside the first transmission module 2'. The second transmission module 4' surrounds outside the first shielding layer 3'. The second shielding layer 5' surrounds outside the second transmission module 4'. The woven layer 6' surrounds outside the second shielding layer 5'. The insulating skin 7' surrounds outside the woven layer 6'. The cable structure 100' further includes a plurality of core wire assemblies 8' disposed in the first transmission module 2' and the second transmission module 4', respectively. Each core wire assembly 8' has at least two conductive wires 81' and at least one ground wire 82'. A wire diameter of each conductive wire 81' is 30 AWG (American Wire Gauge).

However, when the cable structure 100' in the prior art is manufactured with the increase of a length of each conductive wire 81', insertion losses of conductive wires 81' of some of the plurality of the core wire assemblies 8' are excessive so that the cable structure 100' cannot satisfy a high frequency specification, thereby affecting an electrical signal transmission of the cable structure 100'.

Therefore, it is necessary to provide an innovative cable structure, and the innovative cable structure is applied for making conductive wires of the innovative cable structure maintain stable electrical signal transmissions in designs of the conductive wires of the innovative cable structure with different lengths.

SUMMARY OF THE INVENTION

An object of the present invention is to provide a cable structure. The cable structure includes at least one stuffing element, a first transmission module surrounding outside the at least one stuffing element, a first shielding layer surrounding outside the first transmission module, a second transmission module surrounding outside the first shielding layer, a second shielding layer surrounding outside the second transmission module, a woven layer surrounding outside the second shielding layer, an insulating skin surrounding outside the woven layer, a plurality of first core wire assemblies disposed in the first transmission module and the second transmission module, respectively, and at least one second core wire assembly disposed in the first transmission module or the second transmission module. A diameter of each first core wire assembly is different from a diameter of each second core wire assembly.

As described above, because the cable structure includes the plurality of the first core wire assemblies and the at least one second core wire assembly, the cable structure can be applied for making the cable structure maintain stable electrical signal transmissions in designs of the cable structure with the different lengths.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
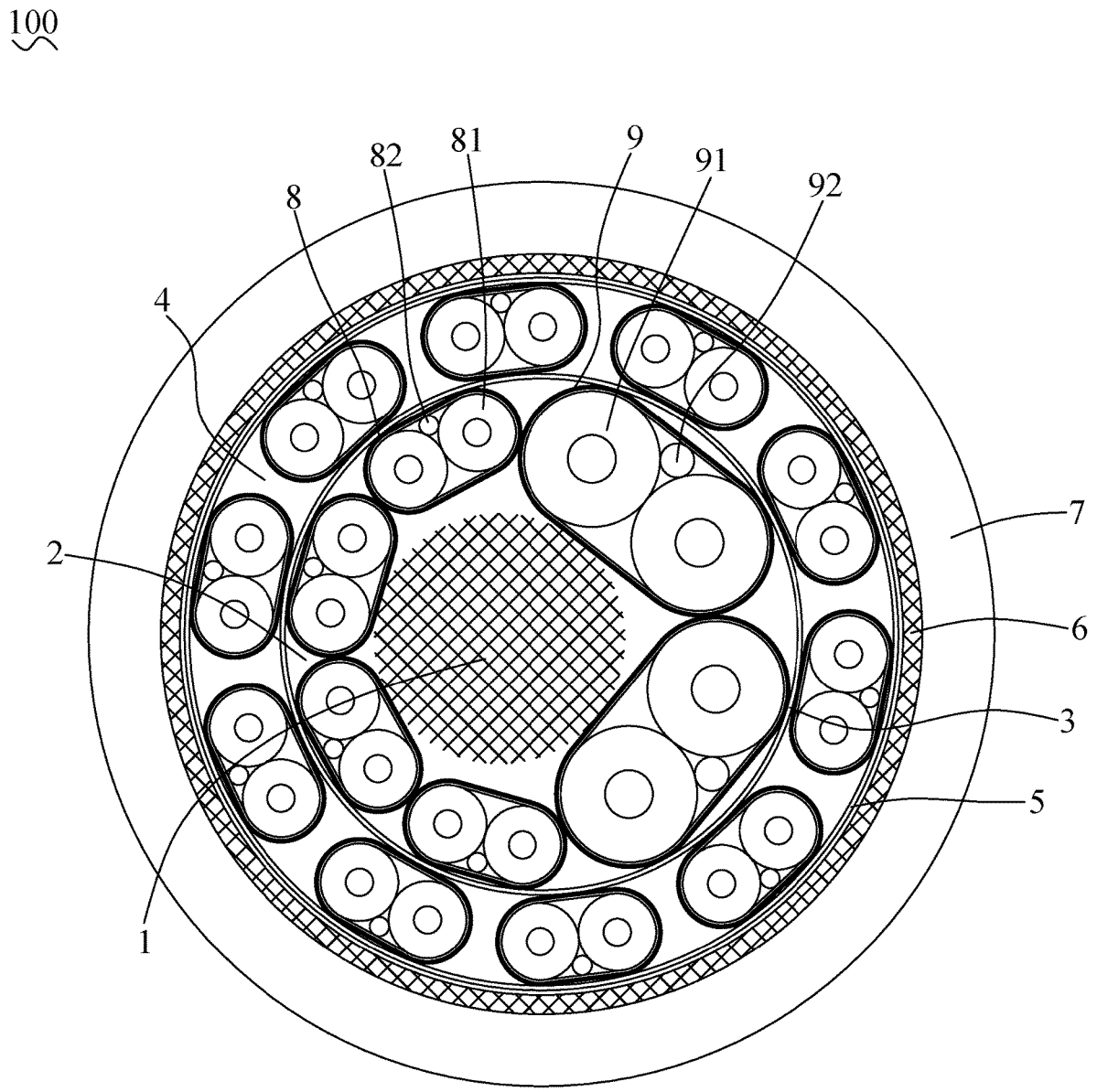
FIG. 1 is a sectional view of a cable structure in accordance with a preferred embodiment of the present invention.
Figure 2:
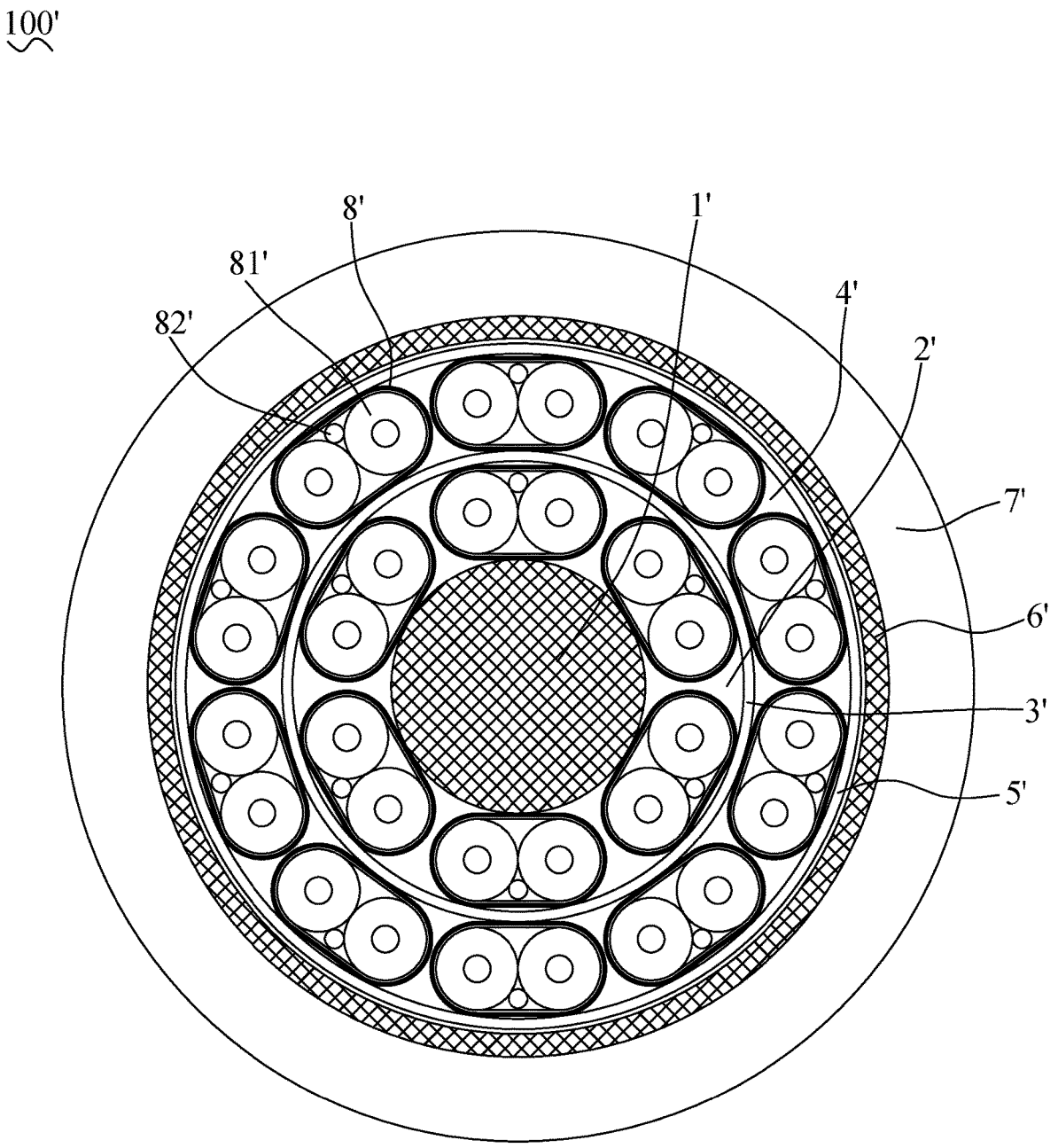
FIG. 2 (Prior Art)
FIG. 2 is a sectional view of a cable structure in prior art.

With reference to FIG. 1, a cable structure 100 in accordance with a first preferred embodiment of the present invention is shown. The cable structure 100, includes at least one stuffing element 1, a first transmission module 2, a first shielding layer 3, a second transmission module 4, a second shielding layer 5, a woven layer 6 and an insulating skin 7.

The first transmission module 2 surrounds outside the at least one stuffing element 1. The first shielding layer 3 surrounds outside the first transmission module 2. The second transmission module 4 surrounds outside the first shielding layer 3. The second shielding layer 5 surrounds outside the second transmission module 4. The woven layer 6 surrounds outside the second shielding layer 5. The insulating skin 7 surrounds outside the woven layer 6.

The cable structure 100 further includes a plurality of first core wire assemblies 8 disposed in the first transmission module 2 and the second transmission module 4, respectively. The cable structure 100 further includes at least one second core wire assembly 9 disposed in the first transmission module 2 or the second transmission module 4. A diameter of each first core wire assembly 8 is different from a diameter of each second core wire assembly 9. Specifically, a long diameter of each first core wire assembly 8 is different from a long diameter of each second core wire assembly 9. A short diameter of each first core wire assembly 8 is different from a short diameter of each second core wire assembly 9.

In this preferred embodiment, each first core wire assembly 8 includes at least one first conductive wire 81 and at least one first ground wire 82. Each second core wire assembly 9 includes at least one second conductive wire 91 and at least one second ground wire 92. A wire diameter of the at least one first conductive wire 81 of each first core wire assembly 8 is different from a wire diameter of the at least one first ground wire 82 of each first core wire assembly 8. A wire diameter of the at least one second conductive wire 91 of each second core wire assembly 9 is different from a wire diameter of the at least one second ground wire 92 of each second core wire assembly 9. The wire diameter of the at least one first conductive wire 81 is different from the wire diameter of the at least one second conductive wire 91. The wire diameter of at least one first ground wire 82 is different from the wire diameter of the at least one second ground wire 92. In this preferred embodiment, each first core wire assembly 8 includes two first conductive wires 81 and one first ground wire 82. Each second core wire assembly 9 includes two second conductive wires 91 and one second ground wire 92. The first transmission module 2 includes four first core wire assemblies 8 and two second core wire assemblies 9. As shown in FIG. 1, preferably the two second core wire assemblies are disposed as adjacent neighbors. The second transmission module 4 includes ten first core wire assemblies 8. In this first preferred embodiment, the wire diameter of the first conductive wire 81 is 30 AWG. The wire diameter of the second conductive wire 91 is 26 AWG.

The stuffing element 1 is PP (Polypropylene) cotton. A material of the first shielding layer 3 is Teflon (Polytetrafluoroethylene, PTFE). Mechanical properties of the Teflon are soft, and have a very low surface energy and an insulating performance. The second shielding layer 5 is an aluminum foil Mylar, and the second shielding layer 5 which is the aluminum foil Mylar is used to eliminate an electromagnetic interference (EMI) and eliminate a radio frequency interference (RFI), and has an electromagnetic shielding function, an antistatic function and a better conductivity. The second shielding layer 5 which is the aluminum foil Mylar provides an electromagnetic shielding effect on account of the second shielding layer 5 having the electromagnetic shielding function.

As described above, because the cable structure 100 includes the plurality of the first core wire assemblies 8 and the at least one second core wire assembly 9, the cable structure 100 can be applied for making the cable structure 100 maintain stable electrical signal transmissions in designs of the cable structure 100 with the different lengths.

What is claimed is:

1. A cable structure, comprising:

at least one stuffing element;

a first transmission module surrounding outside the at least one stuffing element;

a first shielding layer surrounding outside the first transmission module;

a second transmission module surrounding outside the first shielding layer;

a second shielding layer surrounding outside the second transmission module;

a woven layer surrounding outside the second shielding layer;

an insulating skin surrounding outside the woven layer;

a plurality of first core wire assemblies disposed in the first transmission module and the second transmission module, respectively; and at least two second core wire assemblies disposed in the first transmission module or the second transmission module, a diameter of each first core wire assembly being smaller than a diameter of each second core wire assembly, and the at least two second wire assemblies being disposed as adjacent neighbors;

wherein each first core wire assembly includes at least one first conductive wire and at least one first ground wire, each second core wire assembly includes at least one second conductive wire and at least one second ground wire, a wire diameter of the at least one first conductive wire is different from a wire diameter of the at least one second conductive wire, and a wire diameter of the at least one first ground wire is different from a wire diameter of the at least one second ground wire.

2. The cable structure as claimed in claim 1, wherein the wire diameter of the at least one first conductive wire is 30 AWG, the wire diameter of the at least one second conductive wire is 26 AWG.

3. The cable structure as claimed in claim 1, wherein the stuffing element is PP (Polypropylene) cotton.

4. The cable structure as claimed in claim 1, wherein a material of the first shielding layer is a Teflon (Polytetrafluoroethylene, PTFE).

5. The cable structure as claimed in claim 1, wherein the second shielding layer is an aluminum foil Mylar.

6. A cable structure, comprising:

at least one stuffing element;

a first transmission module surrounding outside the at least one stuffing element;

a first shielding layer surrounding outside the first transmission module;

a second transmission module surrounding outside the first shielding layer;

a second shielding layer surrounding outside the second transmission module;

a woven layer surrounding outside the second shielding layer;

an insulating skin surrounding outside the woven layer;

a plurality of first core wire assemblies disposed in the first transmission module and the second transmission module, respectively; and at least two second core wire assemblies disposed in the first transmission module or the second transmission module, a diameter of each first core wire assembly being smaller than a diameter of each second core wire assembly, and the at least two second wire assemblies being disposed as adjacent neighbors;

wherein each first core wire assembly includes two first conductive wires and one first ground wire, and each second core wire assembly includes two second conductive wires and one second ground wire.

7. A cable structure, comprising:

at least one stuffing element;

a first transmission module surrounding outside the at least one stuffing element;

a first shielding layer surrounding outside the first transmission module;

a second transmission module surrounding outside the first shielding layer;

a second shielding layer surrounding outside the second transmission module;

a woven layer surrounding outside the second shielding layer;

an insulating skin surrounding outside the woven layer;

a plurality of first core wire assemblies disposed in the first transmission module and the second transmission module, respectively; and at least two second core wire assemblies disposed in the first transmission module or the second transmission module, a diameter of each first core wire assembly being smaller than a diameter of each second core wire assembly, and the at least two second wire assemblies being disposed as adjacent neighbors;

wherein the plurality of first core wire assemblies disposed in the first transmission module and the second transmission module include four first core wire assemblies disposed in the first transmission module and ten first core wire assemblies disposed in the second transmission module, and the at least two second wire assemblies disposed in the first transmission module or the second transmission module include two second core wire assemblies disposed in the second transmission module.

* * * * *